US008544242B2

(12) United States Patent
Munneke

(10) Patent No.: US 8,544,242 B2
(45) Date of Patent: Oct. 1, 2013

(54) METHOD AND APPARATUS FOR PROCESSING SHEETS OF DIFFERENT SIZES TO A MAIL ITEM

(75) Inventor: Christiaan Antoon Munneke, Drachten (NL)

(73) Assignee: Neopost Technologies, Bagneux (FR)

( * ) Notice: Subject to any disclaimer, the term of this patent is extended or adjusted under 35 U.S.C. 154(b) by 0 days.

(21) Appl. No.: 11/026,311

(22) Filed: Dec. 31, 2004

(65) Prior Publication Data

US 2005/0184441 A1 Aug. 25, 2005

(30) Foreign Application Priority Data

Dec. 31, 2003 (NL) ..... 1025160

(51) Int. Cl.

| | |
|---|---|
| ***B65B 63/04*** | (2006.01) |
| *B42C 1/10* | (2006.01) |
| *B65H 5/24* | (2006.01) |

(52) U.S. Cl.

USPC ..... 53/429; 53/116; 53/155; 53/157; 493/210; 493/25; 493/24; 270/39.01; 270/39.04; 270/51; 270/58.07; 270/58.23; 271/9.01; 271/9.02; 271/9.05

(58) Field of Classification Search

USPC ..... 53/429, 389, 155, 154, 116, 157; 493/210, 23, 25; 270/39.01, 39.04, 49, 51, 270/58.07, 58.23; 271/9.01, 9.02, 9.05, 9.13

See application file for complete search history.

(56) References Cited

U.S. PATENT DOCUMENTS

| | | | | | |
|---|---|---|---|---|---|
| 3,579,947 | A | * | 5/1971 | Kalman | 156/204 |
| 3,961,781 | A | * | 6/1976 | Funk | 493/13 |
| 3,966,186 | A | | 6/1976 | Helm | 270/58 |
| 4,071,997 | A | * | 2/1978 | Gunther et al. | 53/429 |
| 4,575,067 | A | * | 3/1986 | Ciatteo | 270/58.23 |
| 4,694,632 | A | | 9/1987 | Gunther, Jr. | 53/55 |
| 4,696,464 | A | * | 9/1987 | Gammerler | 271/202 |
| 4,784,379 | A | * | 11/1988 | Vander Syde et al. | 270/58.06 |
| 4,875,668 | A | * | 10/1989 | Spyra | 270/45 |
| 4,885,896 | A | * | 12/1989 | Romagnoli | 53/116 |
| 4,972,655 | A | * | 11/1990 | Ogawa | 53/155 |

(Continued)

FOREIGN PATENT DOCUMENTS

| | | |
|---|---|---|
| EP | 0 498 515 A1 | 8/1992 |
| EP | 0 605 066 A1 | 12/1992 |
| EP | 0 556 922 A1 | 8/1993 |
| NL | 9301296 | 2/1995 |

*Primary Examiner* — Hemant M Desai
*Assistant Examiner* — Gloria R Weeks
(74) *Attorney, Agent, or Firm* — Sughrue Mion, PLLC

(57) ABSTRACT

When sheets (1, 2) with different sizes are processed to a mail item, sheets (1, 2) with different sizes in conveying direction are supplied along first and second conveyor tracks, gathered into a stack and then folded. The folding of the stacked set (7) takes place with at least one predetermined folding length (a). In response to a difference between the folding length (a) and the size of the sheet (2) of the second size, which is within a predetermined range, the conveyor tracks (5, 6) are controlled by the control structure (9) for combining at least the sheets (1, 2) with leading edges (10, 11) at a mutual distance in the conveying direction (3) and with trailing edges (12, 13) at a mutual distance in the conveying direction (3) to form the set (7). From the combining until the folding, the sheets (1, 2) are mutually fixed and during folding, at least one fold (14) is provided in the sheets (1, 2).

12 Claims, 2 Drawing Sheets

(56) References Cited

U.S. PATENT DOCUMENTS

| | | | | | |
|---|---|---|---|---|---|
| 5,064,115 | A | | 11/1991 | Steidinger | 229/304 |
| 5,207,412 | A | * | 5/1993 | Coons et al. | 270/45 |
| 5,224,920 | A | * | 7/1993 | Janssen et al. | 493/417 |
| 5,316,279 | A | * | 5/1994 | Corona et al. | 270/1.01 |
| 5,445,368 | A | * | 8/1995 | Lester et al. | 270/59 |
| 5,514,066 | A | * | 5/1996 | Monaco | 493/25 |
| 5,556,086 | A | * | 9/1996 | Munneke et al. | 270/46 |
| 5,568,717 | A | * | 10/1996 | Harrod | 53/429 |
| 5,573,232 | A | * | 11/1996 | Ifkovits et al. | 270/51 |
| 5,681,035 | A | * | 10/1997 | Ifkovits et al. | 270/51 |
| 5,772,194 | A | * | 6/1998 | Huebler et al. | 270/45 |
| 5,816,773 | A | * | 10/1998 | Fehringer et al. | 414/789.9 |
| 5,848,346 | A | * | 12/1998 | Takashiro | 399/404 |
| 5,980,439 | A | * | 11/1999 | Johnson et al. | 493/14 |
| 6,209,860 | B1 | * | 4/2001 | Fehringer et al. | 270/45 |
| 6,226,959 | B1 | * | 5/2001 | Krasuski et al. | 53/117 |
| 6,266,944 | B1 | | 7/2001 | Consiglio | 53/429 |
| 6,481,704 | B1 | * | 11/2002 | Koster et al. | 270/58.23 |
| 6,558,054 | B2 | | 5/2003 | Haller | 400/76 |
| 6,733,006 | B2 | * | 5/2004 | Kobayashi et al. | 270/37 |
| 7,100,911 | B2 | * | 9/2006 | Middelberg et al. | 271/9.01 |
| 7,419,150 | B2 | * | 9/2008 | Kushida et al. | 270/58.07 |
| 7,431,280 | B2 | * | 10/2008 | Stauber et al. | 271/9.13 |
| 7,500,663 | B2 | * | 3/2009 | Higaki et al. | 270/58.12 |
| 7,926,798 | B2 | * | 4/2011 | Taketsugu et al. | 270/37 |

* cited by examiner

METHOD AND APPARATUS FOR PROCESSING SHEETS OF DIFFERENT SIZES TO A MAIL ITEM

CROSS-REFERENCE TO RELATED APPLICATIONS

This application claims priority from Dutch Patent Application No. 1025160 filed on Dec. 31, 2003.

FIELD AND BACKGROUND OF THE INVENTION

The invention relates to a method and an apparatus for processing sheets of different sizes to a mail item. Here, the sheets may also comprise, for instance, address carriers, brochures, reply cards, prepaid envelopes, carriers with a plastic card, etc.

For assembling mail items containing sheets of different sizes, different solutions are known. From American patent publications U.S. Pat. Nos. 4,077,181 and 4,972,655, it is known to fold sheets which have a size in a conveying direction which is larger than the size of the envelope in conveying direction, and then to add a sheet which has a size in conveying direction which is smaller than the size of the envelope in the conveying direction and to insert the set of sheets thus formed into the envelope. However, this imposes limitations on the possible sizes of the small sheet.

From European patent publication 0 556 922, it is known to gather sheets of different sizes in conveying direction prior to the folding, the sheets being fed to the folding station for folding with trailing edges being in alignment. Although this opens up the possibility for sheets of a smaller size in conveying direction which are not folded to be processed together with larger sheets to be folded to form mail items, this processing method also entails limitations with regard to the possible sizes of the small sheet, because reliable and careful folding requires that, for each sheet, a minimum distance of the leading edge to the nearest folding line is observed.

Known from practice is an apparatus marketed by Printed Forms Equipment under the name of "Minimailer" for assembling mail items, with which a small sheet can be placed on a larger sheet such that, after folding, the small sheet is located between the two folds, seen in a direction perpendicular to the folds. However, this also imposes limitations on the possible sizes of the sheet, in that these are limited to the folding length of the panel between the two folds.

SUMMARY OF THE INVENTION

It is an object of the invention, in the processing of sheets to form mail items where folding is involved, to obviate limitations regarding possible sizes in conveying direction of the sheet smaller in conveying direction or sheets smaller in conveying direction.

According to the invention, this object is achieved by providing a method according to claim 1. The invention further provides an apparatus according to claim 4, with which the method according to the invention can be carried out.

Because, of a set of sheets, a small sheet which is smaller in conveying direction than a large sheet of that set can be positioned, with respect to the large sheet, with both its leading edge spaced from the leading edge of the large sheet and its trailing edge spaced from the trailing edge of the large sheet, and the sheets can be held in that relative position until folding, small sheets of a large variety of sizes in conveying direction can be folded together with the large sheet to be folded, without this leading to disturbances during folding. Within the scope of the invention, it is also possible to include two or more of the large and/or the small sheets in a set.

Particular embodiments of the invention are set forth in the dependent claims.

These and further embodiment aspects as well as effects and details of the invention will be described hereinbelow and elucidated with reference to an exemplary embodiment shown in the Figures.

DETAILED DESCRIPTION

Figure 1:
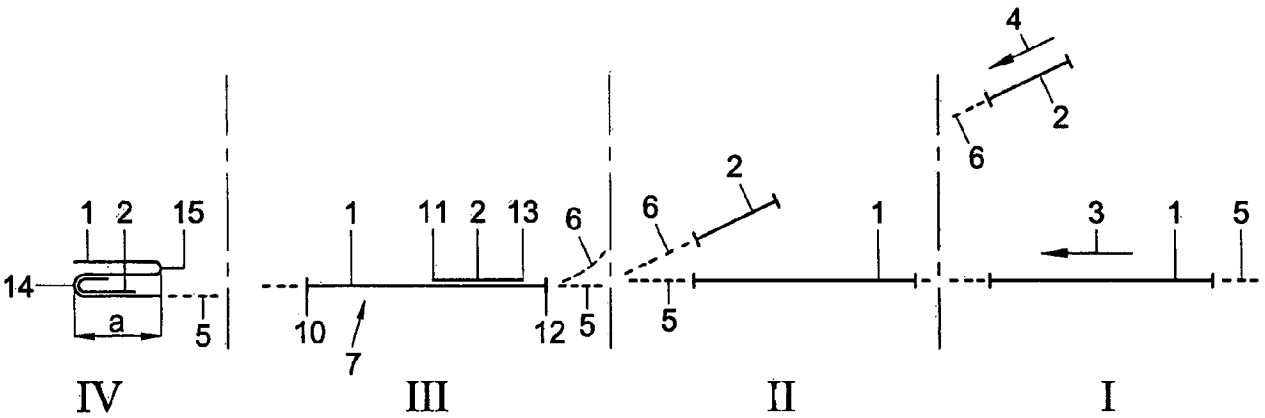
FIG. 1 shows a diagrammatical view of an example of a method according to the invention.

FIG. 1 illustrates an example of the method according to the invention in four successive stages I, II, III and IV shown from right to left.

According to this example, two sheets 1, 2 of a first size and a second size are intended to be processed to a mail item. According to this example, the sheet 1 of the first size is of A4 size and, according to this example, the sheet 2 is 12 cm long, measured in conveying direction.

In stage I, the sheets 1, 2 are conveyed along a first conveyor track 5 and a second conveyor track 6 in conveying directions 3 and 4, respectively.

In stage II, at least one of the sheets 1, 2 is stopped, until the relative positions of the sheets 1, 2 are suitable for combining the sheets 1, 2 to a stacked set 7 and then the sheets 1, 2 are simultaneously conveyed further and combined to a stacked set 7. The condition in which the stacked set 7 has been formed is shown as stage III.

According to this example, the stacked set 7 is then folded twice to a zigzag structure, while, in both cases, a predetermined folding length $\alpha$ of 10 cm stored in a memory 8 of a control structure 9 (see FIGS. 2 and 3) is observed. In this context, a folding length is understood to mean the size in a direction perpendicular to the fold of a panel of a set of sheets adjoining the fold. Depending on the type of folding machine used, it may be advantageous to predetermine, as a folding length, the size transverse to the fold of the panel located in front of or behind a (possibly future) fold. It is also possible to provide more or fewer folds and to fold a set of sheets with different folding lengths. In many cases, the folding length is chosen such that the folded set fits, with a suitable play in a direction perpendicular to the folds, into an envelope into which the sheets are inserted after folding. However, it is also possible that at least one of the sheets of the set has one or more adhesive edges, such as a gummed edge, which are attached to one another during or after folding, so that the sheet forms the cover of the set. The condition of the set 7 processed according to this example after folding is shown as stage IV.

The size in the conveying direction of the small sheet 2 supplied along the second conveyor track 6 has been inputted into the control structure. This size may, for instance, have been scanned during a startup stage prior to the operational stage in which mail items are actually assembled or may have been inputted manually via a user interface.

The difference between the predetermined folding length α and the size of the sheet 2 of the second, smaller size is −2 cm according to this example. This value is within a predetermined range, for which it holds true that, during folding, there is an increased risk of disturbances if the sheet 2 of the second, smaller size is folded with a leading or trailing edge in alignment with the leading and trailing edge, respectively, of the sheet 1 of the first, larger size. The reason for this may, for instance, be that the panel to be folded of the sheet 2 of the second, smaller size is too small to be folded reliably by the folding station or that the length of the panel to be folded of the sheet 2 of the second, smaller size is such that, during folding, the free edge thereof strikes an arch of the sheet 1 of the first, larger size, or cannot be conveyed reliably. In response to the difference determined, thus, the conveying tracks 5, 6 have been controlled by the control structure 9 for combining the sheets 1, 2 to a set with leading edges 10, 11 at a mutual distance in the conveying direction 3 and with trailing edges 12, 13 at a mutual distance in the conveying direction 3. According to this example, the mutual distance of the trailing edges 12, 13 of the sheets 1, 2 is 2 cm.

The sheets 1, 2 of the set 7 are then, from the combining (stage III) to the folding of the set 7 (completed in stage IV), mutually fixed. During folding, a first fold 14 is provided in the two sheets 1, 2 of the set 7 and a second fold 15 is only provided in the sheet 1 of the first, larger size.

Because, during the combining with the sheet 1 of the first, larger size, the sheet 2 of the second, smaller size is positioned with its leading edge 11 at a distance from the leading edge 10 of the sheet 1 of the first, larger size and with its trailing edge 13 at a distance from the trailing edge 12 of the sheet of the first, larger size, the size of the smallest panel to be folded, measured perpendicular to the fold 14, is 4 cm, and not 2 cm as would be the case if the sheets 1, 2 were folded with aligned trailing edges 12, 13. With a smallest panel length of 4 cm and a largest panel length of 8 cm, the sheet 2 of the second, smaller size can reliably be folded along with the sheet 1 of the first, larger size. It is therefore not necessary to stack folded sheets with other sheets, folded or not, and only one folding stage is needed, even if the smaller sheet is to be folded as well.

Because one of the folds 14 is provided in both sheets 1, 2 at the same time, moreover, only one folding action is needed for making the fold 14 in the two sheets 1, 2. After making at least one fold in the two sheets 1, 2 of the set 7, the sheets 1, 2, due to the fold 14 made in the set 7, are less easily movable relative to each other in conveying direction and the set can be driven by pushing the closed side of the fold 14, without the sheets 1, 2 thereby being moved relative to each other.

It is noted that the sheets when being combined into a set are preferably gathered such that the sheet of the first, larger size projects, at its leading and trailing ends, with respect to the sheet of the second, smaller size. Then, the total length in conveying direction of the collected set is not larger than the length in conveying direction of the sheet with the largest size in conveying direction.

This relative positioning during combining is further particularly advantageous if the set contains only one sheet with a largest length in conveying direction and if this sheet is provided with adhesive edges, such as gummed edges. It can then be guaranteed reliably that the panels of the sheet or the sheets of the smaller size or the sheets of the smaller sizes do not cover the adhesive edges after folding and the sheet of the largest size can reliably be processed to an envelope enveloping the other sheet or the other sheets of the respective set.

Figure 2:
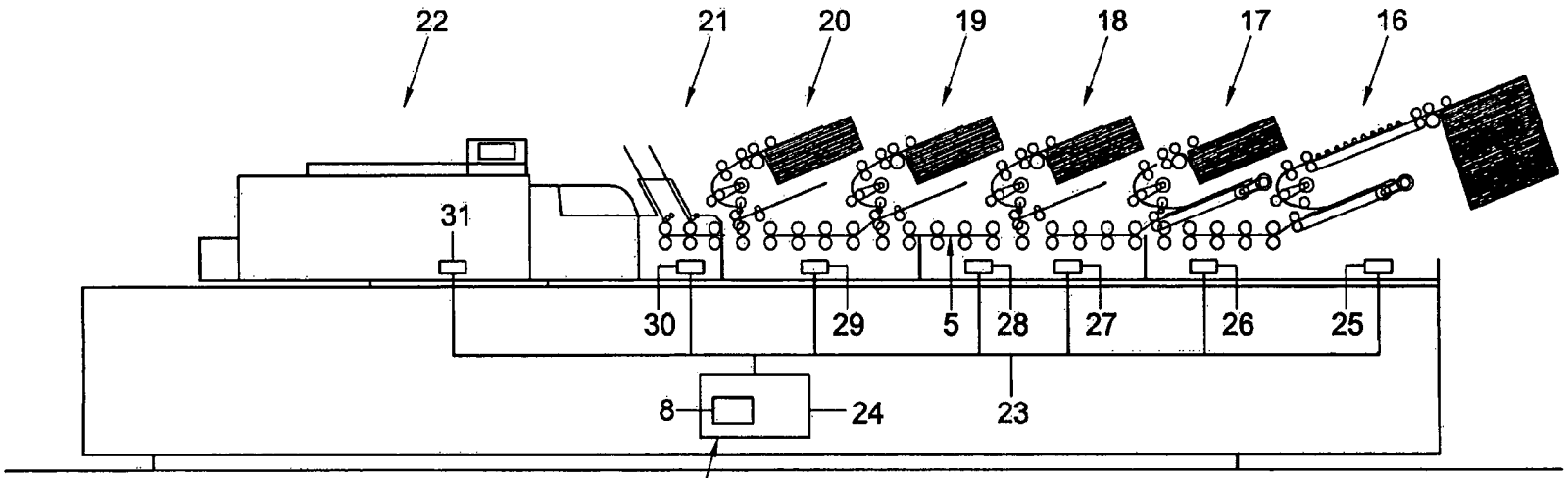
FIG. 2 shows a diagrammatical view of an example of an apparatus according to the invention.
Figure 3:
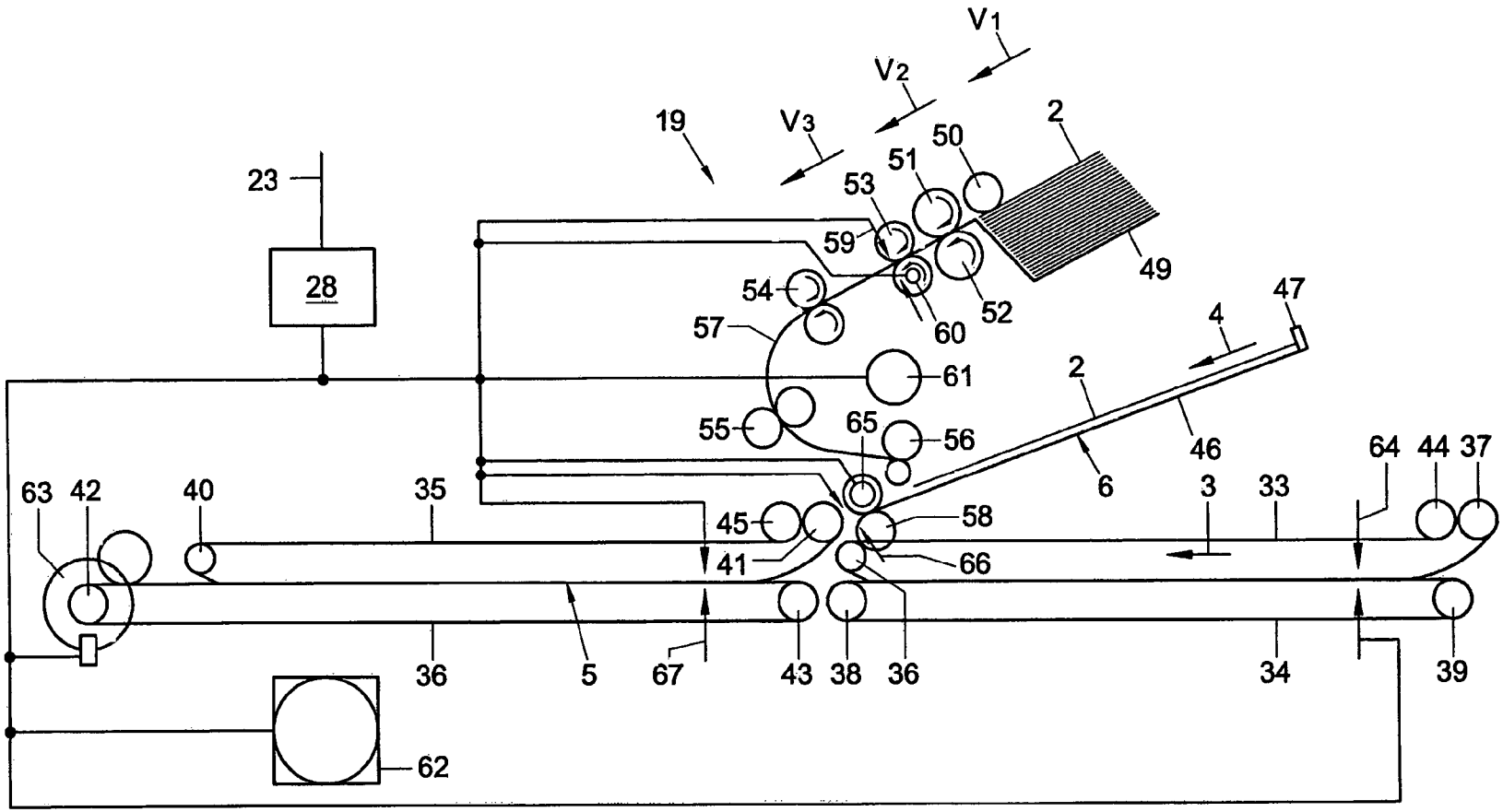
FIG. 3 shows a diagrammatical view of a part of the apparatus according to FIG. 2.

An example of an apparatus with which the method according to the above-described example can be carried out is shown in FIGS. 2 and 3. This apparatus for assembling mail items is provided with a supply station 16 for supplying main documents, supply stations 17-20 for supplying attachments, a folding station 21 and an inserter station 22. The first conveyor track 5 extends from the supply station 16 for supplying main documents to the inserter station 22. The control structure 9 comprises a main control unit 24 with a memory 8 and a connecting structure 23 which operatively connects the main control unit 24 with the station 16-22, as FIG. 2 diagrammatically shows. The stations are provided with distributed control units 25-31 for processing instructions coming from the main control unit 24 and for delivering signals representing the status of the respective station 16-20. According to this example, the supply stations 16-20 are each suitable for feeding multiple sheets to each set. However, the supply stations may also be arranged for each time feeding at most one sheet for each set 7 intended for a mail item.

FIG. 3 shows the attachment supply station 19 of the apparatus according to FIG. 2 in more detail. The first conveyor track 5 for conveying sheets 1 is designed with pairs of opposite sets of conveyor belts 32, 33, 34, 35. The conveyor belts are each tensioned around end rollers 36-44. Tension rollers 44, 45 serve for tensioning the upper conveyor belts 33, 35. The opposite sets of conveyor belts 32-35 operatively ensure that sheets of sets 7 conveyed therebetween are mutually fixed in a reliable manner.

The second conveyor track 6 converging with the first conveyor track 5 is determined by a collecting platform 46 with an adjustable end stop 47 and a pair of conveyor rollers 58 located downstream thereof.

For collecting sheet 2 on the collecting platform 46, means are provided for piece by piece supplying sheets 2 from a stock. For this, many possible solutions are known from the state of the art. According to this example, the means for piece by piece supplying sheets from a stock comprise a sheet holder 49, a supply roller 50 for supplying sheets, a conveyor roller 51 and a separation roller 52 for conveying and, if needed, separating sheets 2 supplied by a supply roller 50, two sets of conveyor rollers 53, 54, 55, 56 for conveying separated sheets at increasing speeds $v_1$, $v_2$, $v_3$ and a diagrammatically shown system of guides 57.

In cooperation with a passage between the upstream belt 33 and the downstream belt 35 of the upper conveyor belts 33, 35, the nip between the pair of conveyor rollers 58 downstream of the collecting platform forms the connection of the second conveyor track 6 to the first conveyor track 5 for each time combining sheets 1, 2 supplied via the first and second conveyor tracks 5, 6 to a stacked set 7.

For controlling the transport of the sheets 2, the means for supplying sheets 2 to the sheet platform 47 comprise a first attachment detector 59 for detecting the presence of a sheet 2 directly downstream of the nip between the conveyor roller pair 53. A coupling 60 operates the drive of the conveyor rollers 50, 51 and 53 upstream of the detector 60 by coupling or uncoupling the detector with or from a motor/pulse disc assembly 61, while the local control unit 28 is arranged for controlling the coupling for stopping sheets in a waiting position with a leading edge shortly beyond the first attachment detector 59 and for each time driving the conveyor rollers 50, 51 and 53 upstream of the detector 60, until the detector has detected and signaled the presence of a leading edge of a next sheet 2.

The central control unit 24 is arranged for determining the folding length or folding lengths a of the set 7 to be folded and for storing data representing the size of the sheets 2 of the second, smaller size in the memory 8. Further, the central control unit 24 is arranged for, in response to the difference between the folding length or folding lengths α and the size of the second sheets which is within a predetermined range, signaling to the respective distributed control units 26-29 of the attachment supply stations 17-20 that, during the combining of sheets 1 and 2, supplied via the first and the second conveyor tracks 5, 6, to the set 7, leading edges 10, 11 of the sheets 1, 2 are to be positioned at a mutual distance in the conveying direction 3 and trailing edges of the sheets 1, 2 are to be positioned at a mutual distance in the conveying direction 3. In response to what range the central control unit 24 does not position the sheets 2 of the second, smaller size with leading or trailing edges 11, 13 in alignment on the leading and trailing edges, respectively, of the sheets 1 of the first, larger size, depends on the specific properties of the specific properties of the folding station 21 with which the sets 7 are folded.

For controlled positioning of the sheets 2 of the second, smaller size with respect to the sheets 1 of the first, larger size in a position with both leading and trailing edges mutually staggered over (directly or indirectly) predetermined distances in conveying direction, the apparatus according to the example shown is designed as follows.

For driving the first conveyor track 5 in the area of the attachment supply station 19, a drive structure is provided, of which an AC motor 62 and a pulse disc 63 are part. Operating means for starting and stopping the first drive structure are formed by the local control unit 28. For this purpose, this is provided with a motor control. This can also be part of the drive structure. For detecting at least one leading or trailing edge of a sheet 1 in the first conveyor track 5, a track monitoring detector 64 has been placed upstream of the area where the second conveyor track 6 connects to the first conveyor track 5.

A second drive structure for driving the second conveyor track 6 is formed by the motor/pulse disc assembly 61 and a second coupling 65 with which the conveyor roller pair 58 downstream of the collecting platform can be coupled with and uncoupled from the motor/pulse disc assembly 61. The local control unit 28 is further arranged for starting and stopping the second drive structure, and in particular the conveyor roller pair 58 downstream of the collecting platform 46, by operating the second coupling 65.

A second attachment detector 66 for detecting at least one leading or trailing edge of a sheet 2 in the second conveyor track 6 is located just downstream of the conveyor roller pair 58 downstream of the collecting platform 46.

The local control unit 28 is arranged for releasing the second conveyor track 6 and for controlling the second coupling 65 for starting the drive of the second conveyor track 6 by coupling and for starting the motor 62 for driving the first conveyor track 5. As a result, sheets 1 and 2 are supplied along the first and second conveyor tracks 5, 6. The local control unit 28 is further arranged for then, in response to detection of a leading or trailing edge 11 or 13 of a sheet 2 in the second conveyor track 6, controlling the second coupling 65 for interrupting the drive of the second conveyor track 6 by uncoupling. As a result, the sheet in the second conveyor track 6 is stopped in a known waiting position. The local control unit 28 is further arranged for then, in response to detection of a leading or trailing edge 10 or 12 of a sheet by the detector 64 along the first conveyor track 5, controlling the second coupling 65 for restarting the drive of the second conveyor track 6 by recoupling. Because the distances from the detector 64 along the first conveyor track 5 and the distance from the second attachment detector 66 along the second conveyor track 6 and from the stop 47 to the place where the second conveyor track 6 converges with the first conveyor track 5 are known, by carrying out the restart of the drive of the second conveyor track 6 at a suitable time, the second sheet 2 can accurately be positioned in any desired position on the first sheet 1.

Downstream of the second conveyor track 6, along the first conveyor track 5, a downstream detector 67 is located for detecting the trailing edge 12 of a set 7 gathered in the attachment supply station 19. The local control unit 28 is arranged for stopping the motor 62 which drives the first conveyor track 5 in response to a signal from the detector 67 which indicates the passage of such a trailing edge 12.

In the following table, in successive lines, successive detections and the actions carried out in response thereto are shown:

TABLE 1

| Detection | Action |
|---|---|
| ready signal (for instance coming from downstream station 20) | coupling 65 IN, motor 62 ON |
| leading edge of sheet 2 at detector; second attachment detector 66 | coupling 65 FREE |
| trailing edge at detector 64 | start counting pulses by pulse disc 3 |
| pulse counting has reached predetermined value | coupling 65 IN |
| trailing edge at detector 67 | coupling 65 FREE, motor 62 OFF |

The pulse disc 63 thus forms a movement indicator coupled with the local control unit 28 of the control structure 9 for detecting movement in conveying direction by the first conveyor track 5. The local control unit 28 is here arranged for restarting the second conveyor track 6 in response to a particular movement indicated by the movement indicator 63, which movement has been chosen such that the sheet 2 of the second size is positioned in the intended position in conveying direction on the sheet 1 of the first size. Although in view of the larger movements along the first conveyor track 5 along which the sheet 1 which is longer in conveying direction is conveyed, it is preferred to stop or at least decelerate the second conveyor track until the intended relative positioning of the sheets 1, 2 has been obtained, it is also possible to stop or decelerate the first conveyor track 5 for obtaining the intended relative positions. Also, in principle, it is possible, depending on the conditions, to decelerate or accelerate the first and/or second conveyor track for obtaining the intended relative positions of the gathered sheets.

The invention claimed is:

1. A method for processing sheets with different sizes to a mail item, comprising:

conveying at least one first sheet along a first conveyor track, the at least one first sheet having a first size along a first conveyor track;

conveying at least one second sheet along a second conveyor track, the at least one second sheet having a second size along a second conveyor track converging with said first conveyor track;

the method subsequently comprising the steps of:

comparing at least one predetermined folding length stored in a memory of a control structure with said second size;

determining a difference between said at least one folding length and said second size;

determining whether said difference between said at least one folding length and said second size is within a predetermined range;

subsequently stacking the at least one sheet of the first size and the at least one sheet of the second size to a stacked set in the first conveyor track; and folding the stacked set with the at least one predetermined folding length;

wherein said first size differs from said second size;

wherein at least said second size is inputted into the control structure;

wherein, in response to said difference between said at least one folding length and said second size being within the predetermined range, said conveyor tracks are controlled by the control structure for performing said stacking such that, in the stacked set leading edges of the first and second sheets are mutually staggered over a predetermined distance along the first conveyor track and trailing edges of the first and second sheets are mutually staggered over a predetermined distance along the first conveyor track to form an offset, staggered relationship between the first and second sheets, the trailing edges of the first and second sheet being opposite the leading edges of the first and second sheet, respectively;

wherein said stacked sheets are maintained mutually fixed such that the mutual distance between leading edges of the first and second sheets and the mutual distance between the trailing edges of the first and second sheets are maintained until the folding;

wherein, during the folding steps, at least one fold is provided in both sheets.

2. A method according to claim 1, wherein said at least one fold is provided in said sheets at the same time.

3. A method according to claim 1, wherein said sheets are inserted into an envelope.

4. A method according to claim 1, wherein said conveyor tracks are controlled by the control structure for combining at least said first and second sheets such that, in the stacked set, along the first conveyor track, the leading and trailing edges of the second sheet are between the leading and trailing edges of the first sheet.

5. A method according to claim 1, wherein, during folding of the stack of sheets, the fold or at least one of the folds is made in the at least one first sheet only.

6. An apparatus for assembling mail items comprising sheets with different sizes, comprising:

a first conveyor track for conveying sheets;

a second conveyor track converging with said first conveyor track for conveying sheets;

a connection of the second conveyor track to the first conveyor track for each time stacking at least one first sheet having a first size supplied via the first conveyor track and at least one second sheet having a second size supplied via the second conveyor track to form a stacked set in the first conveyor track;

a folding station downstream of said connection; and a control structure for:

comparing at least one predetermined folding length stored in a memory of the control structure with said second size along said second conveyor track;

determining a difference between said at least one folding length and said second size;

determining whether said difference between said at least one folding length and said second size of said second sheet is within a predetermined range;

controlling the connection of the second conveyor track to the first conveyor track such that, in response to a difference between a first size of the at least one first sheet along the first conveyor track and the second size of the at least one second sheet along the second conveyor track and said difference between said at least one folding length and the second size within the predetermined range, the first and second conveyor tracks are controlled for subsequently stacking said first and second sheets to form a stack set such that, in the stacked set, leading edges of the first and second sheets are mutually staggered over a predetermined distance along the first conveyor track and trailing edges of the first and second sheets are mutually staggered over a predetermined distance along the first conveyor track to form an offset, staggered relationship between the first and second sheets, the trailing edges of the first and second sheet being opposite the leading edges of the first and second sheet, respectively; and instructing said folding station for folding said supplied stacked set with at least one predetermined folding length stored in the memory of a control structure; and wherein the first conveyor track is arranged for conveying the stacked set to the folding station while maintaining the leading edges of the first and second sheets at the mutual distance and the trailing edges of the first and second sheets at the mutual distance.

7. An apparatus according to claim 6, comprising:

a first drive structure for driving the first conveyor track;

a first detector for detecting at least one leading or trailing edge of a sheet in the first conveyor track;

a second drive structure for driving the second conveyor track; and a second detector for detecting at least one leading or trailing edge of a sheet in the second conveyor track;

wherein said control structure is arranged for starting the first and second drive structures, for then stopping at least the first or the second drive structure in response to detection of a leading or trailing edge of a sheet in the first or second conveyor track, respectively, and for then restarting at least the first or the second drive structure, respectively, in response to detection of a leading or trailing edge of a sheet in the second or the first conveyor track, respectively.

8. An apparatus according to claim 7, further comprising a movement indicator coupled with the control structure for detecting movement in conveying direction by the first or second conveyor track, wherein the control structure is arranged for restarting the second or the first conveyor track, respectively, in response to a particular movement indicated by said movement indicator.

9. An apparatus according to claim 6, wherein said control structure is arranged for controlling the conveyor tracks for combining at least said first and second sheets such that, in the stacked set, along the first conveyor track, the leading and trailing edges of the second sheet are between the leading and trailing edges of the first sheet.

10. An apparatus according to claim 6, wherein the control structure is arranged for controlling said conveyor tracks for combining at least said first and second sheets such that, during folding of the stack of sheets, the fold or at least one of the folds is made in the at least one first sheet only.

11. A method for processing sheets with different sizes to a mail item, comprising:

storing at least one predetermined folding length in a memory of a control structure;

connecting said control structure operatively with a folding station;

conveying at least one first sheet along a first conveyor track, the at least one first sheet having a first size along a first conveyor track;

conveying at least one second sheet along a second conveyor track, the at least one second sheet having a second size along the second conveyor track;

wherein said second conveyor track converges with said first conveyor track;

wherein said first size is larger than said second size;

wherein trailing edges of the first and second sheet are opposite leading edges of the first and second sheet, respectively;

said method subsequently comprising the steps of:

determining a difference between said at least one folding length and said second size;

determining whether a difference between said at least one predetermined folding length and said second size of the second sheet would be within a predetermined range for which there is an increased risk of disturbances should a stacked set of sheets be folded with the at least one predetermined folding length with a leading or trailing edge of a first sheet being in alignment with a leading or trailing edge of the second sheet, respectively;

wherein, in response to said difference between said at least one folding length and said second size not being within the predetermined range, controlling the first and second conveyor tracks by the control structure to position the at least one second sheet and the at least one first sheet such that the leading or trailing edge of said at least one second sheet is in alignment with the leading or trailing edge of the at least one first sheet, respectively, to obtain a stacked set;

wherein, in response to said difference between said at least one folding length and said second size being within the predetermined range, controlling said first and second conveyor tracks by the control structure to stagger the leading edge of the at least one second sheet at a predetermined distance from the leading edge of the at least one first sheet and the trailing edge of the at least one second sheet at a predetermined distance from the trailing edge of the at least one first sheet to form an offset, staggered relationship between the first and second sheets to obtain the stacked set such that the size of the smallest panel to be folded is such that the at least one second sheet can be reliably folded;

wherein said stacked sheets in said stacked set are maintained mutually fixed such that the mutual distance between leading edges of the first and second sheets and the mutual distances between the trailing edges of the first and second sheets are maintained until folding;

folding the stacked set with the at least one predetermined folding length according to folding station processing instructions from the control structure while observing the predetermined folding length; and wherein, during the folding, at least one fold is provided in both sheets.

12. An apparatus for assembling mail items comprising sheets with different sizes, comprising:

a first conveyor track for conveying at least one first sheet, the at least one first sheet having a first size;

a second conveyor track converging with said first conveyor track and conveying at least one second sheet, the at least one second sheet having a second size; wherein trailing edges of the at least first and at least second sheet are opposite leading edges of the at least one first and at least one second sheet, respectively;

a connection between the second conveyor track and the first conveyor track configured to combine the at least one first sheet and the at least one second sheet to form a stacked set in the first conveyor track;

a control structure comprising a memory for storing at least one predetermined folding length; and a folding station downstream of said connection, operatively connected to said control structure for processing instructions sent from the control structure;

wherein the first conveyor track is configured for conveying the stacked set to the folding station while maintaining the leading edges of the at least one first sheet and at least one second sheet at a mutual distance and the trailing edges of the at least one first sheet and the at least one second sheet at a mutual distance;

said control structure being configured to:

compare said at least one predetermined folding length with said second size;

determining a difference between said at least one folding length and said second size determining whether a difference between said at least one predetermined folding length and said second size is within a predetermined range for which there is an increased risk of disturbances should a stacked set of sheets be folded with the at least one predetermined folding length with a leading or trailing edge of the at least one first sheet being in alignment with a leading or trailing edge of the at least one second sheet, respectively;

control said first and second conveyor tracks, in response to said difference between said at least one folding length and said second size not being within the predetermined range, to position the at least one second sheet and the at least one first sheet such that the leading or trailing edge of said at least one second sheet is in alignment with the leading or trailing edge of the at least one first sheet, respectively, to obtain a stacked set;

control said first and second conveyor tracks, in response to said difference between said at least one folding length and said second size being within the predetermined range, to position stagger the at least one second sheet with its leading edge at a predetermined distance from the leading edge of the at least one first sheet and with its trailing edge at a predetermined distance from the trailing edge of the at least one first sheet to form an offset, staggered relationship between the first and second sheets and to obtain a stacked set such that the size of the smallest panel to be folded is such that the at least one second sheet can be reliably folded; and instruct the folding station to fold said stacked set with the at least one predetermined folding length.

* * * * *